US011697934B2

(12) United States Patent
Zemler et al.

(10) Patent No.: US 11,697,934 B2
(45) **Date of Patent: *Jul. 11, 2023**

(54) DYNAMIC, FIRE-RESISTANCE-RATED THERMALLY INSULATING AND SEALING SYSTEM FOR USE WITH CURTAIN WALL STRUCTURES

(71) Applicant: Hilti Aktiengesellschaft, Schaan (LI)

(72) Inventors: Matthew Zemler, Corinth, TX (US); Chad Stroike, Roanoke, TX (US); Arndt Andresen, North Richland Hills, TX (US)

(73) Assignee: Hilti Aktiengesellschaft, Schaan (LI)

( * ) Notice: Subject to any disclaimer, the term of this patent is extended or adjusted under 35 U.S.C. 154(b) by 0 days.

This patent is subject to a terminal disclaimer.

(21) Appl. No.: 17/660,107

(22) Filed: Apr. 21, 2022

(65) Prior Publication Data

US 2022/0243461 A1 Aug. 4, 2022

Related U.S. Application Data

(63) Continuation of application No. 16/610,512, filed as application No. PCT/EP2018/063088 on May 18, (Continued)

(51) Int. Cl.
*E04B 1/76* (2006.01)
*E04B 1/94* (2006.01)
(Continued)

(52) U.S. Cl.
CPC ..... *E04B 1/7675* (2013.01); *E04B 1/7616* (2013.01); *E04B 1/7625* (2013.01);
(Continued)

(58) Field of Classification Search
CPC .... E04B 1/6815; E04B 1/7612; E04B 1/7616; E04B 1/7625; E04B 1/7675; E04B 1/94;
(Continued)

(56) References Cited

U.S. PATENT DOCUMENTS 3,604,167 A 9/1971 Hays
3,786,604 A 1/1974 Kramer
(Continued)

FOREIGN PATENT DOCUMENTS

CA 2 787 642 3/2013
CA 2 841 523 9/2014
(Continued)

OTHER PUBLICATIONS

International Search Report dated Aug. 30, 2018 in PCT/EP2018/063088.

(Continued)

*Primary Examiner* — James M Ference
(74) *Attorney, Agent, or Firm* — Grüneberg and Myers PLLC

(57) ABSTRACT

An approved dynamic construction is used for effectively thermally insulating and sealing of a safing slot between a floor of a building and an exterior wall construction. The exterior wall construction includes a curtain wall configuration defined by an interior wall glass surface including one or more aluminum framing members, where the vision glass extends to the finished floor level below. The dynamic, thermally insulating and sealing system includes a first element for receiving the insulating elements, and is positioned in the zero spandrel area of a glass curtain wall construction including only vision glass, to maintain thermally insulating and sealing of the safing slot during exposure to fire and heat as well as movement in order to maintain a complete seal extending across the safing slot.

15 Claims, 2 Drawing Sheets

Related U.S. Application Data

2018, now Pat. No. 11,339,566, which is a continuation of application No. 15/600,295, filed on May 19, 2017, now Pat. No. 10,202,759.

(51) Int. Cl.

| | |
|---|---|
| ***E04B 2/90*** | (2006.01) |
| ***E04B 2/96*** | (2006.01) |
| *E04B 1/68* | (2006.01) |
| *E04B 1/84* | (2006.01) |

(52) U.S. Cl.

CPC ..... *E04B 1/948* (2013.01); *E04B 2/90* (2013.01); *E04B 2/96* (2013.01); *E04B 1/6815* (2013.01); *E04B 1/7612* (2013.01); *E04B 1/94* (2013.01); *E04B 2001/8438* (2013.01)

(58) Field of Classification Search

CPC ... E04B 1/948; E04B 2/90; E04B 2/96; E04B 2001/8438

See application file for complete search history.

(56) References Cited

U.S. PATENT DOCUMENTS

| | | | | |
|---|---|---|---|---|
| 4,449,341 | A | 5/1984 | Taglianetti et al. | |
| 4,517,779 | A | 5/1985 | Dunsworth | |
| 4,571,905 | A | 2/1986 | Kaminaga | |
| 4,669,240 | A | 6/1987 | Amormino | |
| 4,873,805 | A | 10/1989 | Ting | |
| 5,154,029 | A | 10/1992 | Sturgeon | |
| 5,502,937 | A | 4/1996 | Wilson | |
| 5,765,332 | A | 6/1998 | Landin et al. | |
| 6,058,668 | A | 5/2000 | Herren | |
| 6,360,502 | B1 | 3/2002 | Stahl, Jr. | |
| D502,147 | S | 2/2005 | Stahl, Sr. | |
| 7,240,905 | B1 | 7/2007 | Stahl, Sr. | |
| 7,373,761 | B2 | 5/2008 | Stahl, Sr. | |
| 7,424,793 | B1 | 9/2008 | Shriver | |
| 7,427,050 | B2 | 9/2008 | Stahl, Sr. et al. | |
| 7,523,590 | B2 | 4/2009 | Stahl, Sr. | |
| 7,596,914 | B2 | 10/2009 | Stahl, Sr. et al. | |
| 7,644,549 | B2 | 1/2010 | Speck | |
| 7,685,792 | B2 | 3/2010 | Stahl, Sr. et al. | |
| 7,694,474 | B1 | 4/2010 | Stahl, Sr. et al. | |
| 7,797,893 | B2 | 9/2010 | Stahl, Sr. et al. | |
| 7,827,746 | B2 | 11/2010 | Speck | |
| 7,856,775 | B2 | 12/2010 | Stahl, Jr. | |
| D657,232 | S | 4/2012 | Stahl, Sr. et al. | |
| 8,234,827 | B1 | 8/2012 | Schroeder, Sr. et al. | |
| 8,375,666 | B2 | 2/2013 | Stahl, Jr. et al. | |
| 8,397,452 | B2 | 3/2013 | Stahl, Sr. et al. | |
| 8,464,485 | B2 | 6/2013 | Hilburn | |
| 8,584,415 | B2 | 11/2013 | Stahl, Jr. et al. | |
| 8,671,645 | B1 | 3/2014 | Shriver | |
| 8,683,763 | B2 * | 4/2014 | Shriver | E04B 1/947 52/235 |
| 8,793,946 | B2 | 8/2014 | Stahl, Jr. et al. | |
| 8,869,475 | B2 | 10/2014 | Lopes | |
| 8,887,458 | B2 | 11/2014 | Lopes | |
| 8,955,275 | B2 | 2/2015 | Stahl, Jr. | |
| 9,016,013 | B2 | 4/2015 | Stahl, Jr. et al. | |
| 9,016,014 | B2 | 4/2015 | Shriver | |
| 9,869,086 | B2 | 1/2018 | Andresen | |
| 10,017,939 | B2 | 7/2018 | Andresen | |
| 10,138,629 | B2 | 11/2018 | Schulz-Hanke et al. | |
| 10,202,759 | B2 | 2/2019 | Andresen et al. | |
| 10,538,915 | B1 | 1/2020 | Zemler et al. | |
| 10,648,172 | B2 | 5/2020 | Andresen et al. | |
| 10,669,709 | B2 | 6/2020 | Zemler et al. | |
| 10,731,338 | B1 | 8/2020 | Zemler et al. | |
| 11,002,007 | B2 | 5/2021 | Zemler et al. | |
| 11,124,962 | B2 | 9/2021 | Andresen et al. | |
| 11,339,566 | B2 * | 5/2022 | Zemler | E04B 2/90 |
| 2006/0016133 | A1 | 1/2006 | Speck | |
| 2006/0138251 | A1 | 6/2006 | Stahl, Sr. | |
| 2007/0125018 | A1 | 6/2007 | Stahl, Sr. | |
| 2007/0151183 | A1 | 7/2007 | Stahl, Sr. et al. | |
| 2007/0175125 | A1 | 8/2007 | Stahl, Sr. et al. | |
| 2007/0204540 | A1 | 9/2007 | Stahl, Sr. et al. | |
| 2007/0261339 | A1 | 11/2007 | Stahl, Sr. et al. | |
| 2007/0261343 | A1 | 11/2007 | Stahl, Sr. et al. | |
| 2009/0126297 | A1 | 5/2009 | Stahl, Jr. | |
| 2010/0107532 | A1 | 5/2010 | Shriver | |
| 2011/0011019 | A1 | 1/2011 | Stahl, Jr. et al. | |
| 2011/0088342 | A1 | 4/2011 | Stahl, Sr. et al. | |
| 2011/0094759 | A1 | 4/2011 | Lopes | |
| 2012/0180414 | A1 | 7/2012 | Burgess | |
| 2013/0061544 | A1 | 3/2013 | Stahl, Jr. et al. | |
| 2013/0091790 | A1 | 4/2013 | Stahl, Jr. et al. | |
| 2013/0097948 | A1 | 4/2013 | Burgess | |
| 2014/0020915 | A1 | 1/2014 | Lopes | |
| 2014/0137494 | A1 | 5/2014 | Stahl, Jr. et al. | |
| 2014/0360115 | A1 | 12/2014 | Stahl, Jr. | |
| 2015/0007515 | A1 | 1/2015 | Stahi, Jr. | |
| 2015/0047276 | A1 | 2/2015 | Gandolfo et al. | |
| 2015/0113891 | A1 | 4/2015 | Evensen et al. | |
| 2015/0240488 | A1 | 8/2015 | Evensen et al. | |
| 2016/0356034 | A1 | 12/2016 | Andresen | |
| 2017/0145685 | A1 | 5/2017 | Andresen | |
| 2017/0284085 | A1 | 10/2017 | Ting | |
| 2018/0163397 | A1 | 6/2018 | Long et al. | |
| 2018/0266589 | A1 | 9/2018 | Stroike et al. | |
| 2018/0334799 | A1 | 11/2018 | Andresen et al. | |
| 2019/0071865 | A1 | 3/2019 | Andresen et al. | |
| 2019/0284798 | A1 | 9/2019 | Klein et al. | |
| 2020/0263417 | A1 | 8/2020 | Zemler et al. | |
| 2020/0291644 | A1 | 9/2020 | Ober et al. | |
| 2020/0332525 | A1 | 10/2020 | Klein et al. | |
| 2021/0156141 | A1 | 5/2021 | Zemler et al. | |
| 2022/0243461 | A1 * | 8/2022 | Zemler | E04B 1/7675 |

FOREIGN PATENT DOCUMENTS

| | | |
|---|---|---|
| CA | 2 849 597 | 12/2014 |
| GB | 2503465 | 1/2014 |
| JP | 2011-190613 | 9/2011 |
| JP | 2011-190614 | 9/2011 |
| JP | 2012-225082 | 11/2012 |
| KR | 10-1168757 | 7/2012 |
| WO | 2007/061572 | 5/2007 |
| WO | 2014/081446 | 5/2014 |
| WO | 2015/023313 | 2/2015 |

OTHER PUBLICATIONS

Written Opinion dated Aug. 30, 2018 in PCT/EP2018/063088.

Document 6, Filed Oct. 27, 2022, "First Amended Complaint for Patent Infringement" in Case 1:22-cv-01383-CFC (in the U.S. District Court for the District of Delaware).

Exhibit 1 to Document 6, Filed Oct. 27, 2022, "First Amended Complaint for Patent Infringement" in Case 1:22-cv-01383-CFC (in the U.S. District Court for the District of Delaware).

Exhibit 2 to Document 6, Filed Oct. 27, 2022, "First Amended Complaint for Patent Infringement" in Case 1:22-cv-01383-CFC (in the U.S. District Court for the District of Delaware).

Exhibit 3 to Document 6, Filed Oct. 27, 2022, "First Amended Complaint for Patent Infringement" in Case 1:22-cv-01383-CFC (in the U.S. District Court for the District of Delaware).

Exhibit 4 to Document 6, Filed Oct. 27, 2022, "First Amended Complaint for Patent Infringement" in Case 1:22-cv-01383-CFC (in the U.S. District Court for the District of Delaware).

Exhibit 5 to Document 6, Filed Oct. 27, 2022, "First Amended Complaint for Patent Infringement" in Case 1:22-cv-01383-CFC (in the U.S. District Court for the District of Delaware).

Exhibit 6 to Document 6, Filed Oct. 27, 2022, "First Amended Complaint for Patent Infringement" in Case 1:22-cv-01383-CFC (in the U.S. District Court for the District of Delaware).

Exhibit 7 to Document 6, Filed Oct. 27, 2022, "First Amended Complaint for Patent Infringement" in Case 1:22-cv-01383-CFC (in the U.S. District Court for the District of Delaware).

(56) References Cited

OTHER PUBLICATIONS

Exhibit 8 to Document 6, Filed Oct. 27, 2022, "First Amended Complaint for Patent Infringement" in Case 1:22-cv-01383-CFC (in the U.S. District Court for the District of Delaware).
Exhibit 9 to Document 6, Filed Oct. 27, 2022, "First Amended Complaint for Patent Infringement" in Case 1:22-cv-01383-CFC (in the U.S. District Court for the District of Delaware).
Exhibit 10 to Document 6, Filed Oct. 27, 2022, "First Amended Complaint for Patent Infringement" in Case 1:22-cv-01383-CFC (in the U.S. District Court for the District of Delaware).
Exhibit 11 to Document 6, Filed Oct. 27, 2022, "First Amended Complaint for Patent Infringement" in Case 1:22-cv-01383-CFC (in the U.S. District Court for the District of Delaware).
Exhibit 12 to Document 6, Filed Oct. 27, 2022, "First Amended Complaint for Patent Infringement" in Case 1:22-cv-01383-CFC (in the U.S. District Court for the District of Delaware).
Exhibit 13 to Document 6, Filed Oct. 27, 2022, "First Amended Complaint for Patent Infringement" in Case 1:22-cv-01383-CFC (in the U.S. District Court for the District of Delaware).
Exhibit 14 to Document 6, Filed Oct. 27, 2022, "First Amended Complaint for Patent Infringement" in Case 1:22-cv-01383-CFC (in the U.S. District Court for the District of Delaware).
Exhibit 15 to Document 6, Filed Oct. 27, 2022, "First Amended Complaint for Patent Infringement" in Case 1:22-cv-01383-CFC (in the U.S. District Court for the District of Delaware).
Exhibit 16 to Document 6, Filed Oct. 27, 2022, "First Amended Complaint for Patent Infringement" in Case 1:22-cv-01383-CFC (in the U.S. District Court for the District of Delaware).
Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 1 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 2 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 3 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 4 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 5 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 6 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 7 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 8 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 9 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 10 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 11 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 12 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).

* cited by examiner

DYNAMIC, FIRE-RESISTANCE-RATED THERMALLY INSULATING AND SEALING SYSTEM FOR USE WITH CURTAIN WALL STRUCTURES

CROSS-REFERENCE TO RELATED APPLICATIONS

This application is a continuation of U.S. application Ser. No. 16/610,512, filed on Nov. 3, 2019, which was the National Stage entry under § 371 of International Application No. PCT/EP2018/063088, filed on May 18, 2018, and which claims the benefit of priority to U.S. application Ser. No. 15/600,295, filed on May 19, 2017. The content of each of these applications is hereby incorporated by reference in its entirety.

FIELD OF THE INVENTION

The present invention relates to the field of constructions, assemblies and systems designed to thermally and acoustically insulate and seal a safing slot area defined between a curtain wall and the individual floors of a building. In particular, the present invention relates to a dynamic, fire-resistance-rated thermally insulating and sealing system for use with curtain wall structures, which include glass, especially vision glass extending to the finished floor level below. Further, the present invention relates to a dynamic, thermally insulating and sealing system, parts of which provide a pre-fabricated device for use within a unitized panel construction.

BACKGROUND OF THE INVENTION

Curtain walls are generally used and applied in modern building constructions and are the outer covering of said constructions in which the outer walls are non-structural, but merely keep the weather out and the occupants in. Curtain walls are usually made of a lightweight material, reducing construction costs and weight. When glass is used as the curtain wall, a great advantage is that natural light can penetrate deeper within the building.

A curtain wall generally transfers horizontal wind loads that are incident upon it to the main building structure through connections at floors or columns of the building. Curtain walls are designed to resist air and water infiltration, sway induced by wind and seismic forces acting on the building and its own dead load weight forces. Curtain walls differ from store-front systems in that they are designed to span multiple floors, and take into consideration design requirements such as thermal expansion and contraction, building sway and movement, water diversion, and thermal efficiency for cost-effective heating, cooling, and lighting in the building.

However, architects and the public at large appreciate the aesthetics of glass and other light-transmitting materials used in the built environment. Light-transmitting materials, that serve both an aesthetic function as well as a structural function, are appreciated for their economy and visual effects. A common means prescribed by architects to achieve these goals in building structures is through the use of glass curtain wall systems.

Atypical glass curtain wall structure is designed with extruded aluminum members. The aluminum frame is typically infilled with glass, which provides an architecturally pleasing building, as well as benefits such as daylighting. Usually, for commercial construction, ¼ inch glass is used only in spandrel areas, while 1 inch insulating glass is used for the rest of the building. In residential construction, thicknesses commonly used are ⅛ inch glass in spandrel areas and ⅝ inch glass as insulating glass. Larger thicknesses are typically employed for buildings or areas with higher thermal, relative humidity, or sound transmission requirements. However, outside-inside sound transmission correlation is usually relevant for all type of residential buildings.

With a curtain wall, any glass may be used which can be transparent, translucent, or opaque, or in varying degrees thereof. Transparent glass usually refers to vision glass in a curtain wall. Spandrel or vision glass may also contain translucent glass, which could be for security or aesthetic purposes. Opaque glass is used in areas to hide a column or spandrel beam or shear wall behind the curtain wall. Another method of hiding spandrel areas is through shadow box construction, i.e. providing a dark enclosed space behind the transparent or translucent glass. Shadow box construction creates a perception of depth behind the glass that is sometimes desired. Aesthetic design and performance levels of curtain walls can be extremely varied. Frame system widths, depths, anchoring methods, and accessories have grown diverse due to industry and design innovation.

In general, a glass curtain wall structure or glass curtain wall construction is defined by an interior wall glass surface including one or more framing members and at least one floor spatially disposed from the interior wall surface. The gap between the floor and the interior wall surface of a curtain wall defines a safing slot, also referred to as perimeter slab edge (void), extending between the interior wall surface of the curtain wall construction and the outer edge of the floor. This safing slot is essential to slow the passage of fire and combustion gases between floors. Therefore, it is of great importance to improve fire stopping at the safing slot in order to keep heat, smoke and flames from spreading from one floor to an adjacent floor.

Due to the increasingly strict requirements regarding fire-resistance as well as horizontal and vertical movement, there is a need for a dynamic, thermally and acoustically insulating and sealing system for a curtain wall structure that is capable of meeting or exceeding existing fire test and building code requirements and standards including existing exceptions. In particular, there is a need for systems that prevent the spread of fire when vision glass of a curtain wall structure extends to the finished floor level below even when exposed to certain movements. Further, there is a need for systems that address the architectural limitation of the width of a column or spandrel beam or shear wall behind the curtain wall. Additionally, maintaining safing insulation between the floors of a residential or commercial building and the exterior curtain wall responsive to various conditions including fire, wind and earthquake exposure should be guaranteed.

Further, there is a need for systems that can be easily installed within a safing slot, where, for example, access is only needed from one side, implementing a one-sided application. Further, there is a need for systems that are not limited to the width of a joint of a curtain wall structure thereby compensating at the same time dimensional tolerances of the concreted floor and allowing movement between the floor and the façade element caused by load, temperature or wind load. Moreover, there is a need for systems that improve fire-resistance as well as sound-resistance and can be easily integrated during installation of the curtain wall structure.

Still further there is a need for systems, that can be installed into a unitized panel, making it easier for the installers to the install the pre-assembled curtain wall panel on the jobsite. Hence, there is a need for systems that decrease the complexity in the manufacturing of unitized panels and reduce significantly the cost of materials employed.

In view of the above, it is an object of the present invention to provide a dynamic, thermally insulating and sealing system for effectively thermally insulating and sealing of a safing slot within a building construction, having a curtain wall construction defined by an interior wall surface including one or more framing members and at least one floor spatially disposed from the interior wall surface of the curtain wall construction, wherein the vision glass of a curtain wall structure extends to the finished floor level below.

Still further, it is an object of the present invention to provide a system that utilizes no aluminum or faced curtain wall insulation, and the safing insulation can be pre-installed from one side, which maintains the safing insulation between the floors of a residential or commercial building and the glass curtain wall responsive to various conditions, including fire exposure, and maximizes safing insulation at a minimal cost.

Still further, it is an object of the present invention to provide a building construction comprising of such a dynamic, thermally insulating and sealing system for effectively thermally insulating and sealing of the safing slot between a glass curtain wall structure and the edge of a floor, in particular within the zero spandrel area, wherein the vision glass of a curtain wall structure extends to the finished floor level below.

Still further, it is an object of the present invention to provide a system that can be easily installed within a safing slot, where, for example, access is only needed from one side, implementing a one-sided application.

Still further, it is an object of the present invention to provide a system that can be installed into a unitized panel, making it easier for the installers to build up the curtain wall on the jobsite and hence, decreases the complexity in the manufacturing of unitized panels and reducing significantly the cost of materials employed.

Still further, it is an object of the present invention to provide at the same time an acoustic insulating and sealing system for effectively acoustically insulating and sealing of the safing slot between a curtain wall structure and the edge of a floor.

These and other objectives as they will become apparent from the ensuring description of the invention are solved by the present invention as described in the independent claims. The dependent claims pertain to preferred embodiments.

SUMMARY OF THE INVENTION

In one aspect, the present invention provides a dynamic, thermally insulating and sealing system for effectively thermally insulating and sealing of a safing slot within a building construction having a curtain wall construction defined by an interior wall surface including at least one vertical and at least one horizontal framing member and at least one floor spatially disposed from the interior wall surface of the curtain wall construction defining the safing slot extending between the interior wall surface of the curtain wall construction and an outer edge of the floor, comprising a first element comprised of a non-combustible material for receiving a thermally resistant material for insulating, wherein the first element is comprised of a plate having opposing edges and an inner and an outer surface, and wherein the plate has a moment of inertia that is sufficient enough to keep a second and third element in place, wherein the plate is recessed at least 2 inch from an inner side of the framing member and extending at least 5 inch below the vertical framing member, at least one supplemental element for attaching of the first element with respect to at least one side of the horizontal and/or vertical framing member of the curtain wall construction, a second element comprised of a thermally resistant material for insulating, wherein the second element includes an outer primary end surface positionable in abutment with respect to the inner surface of the first element; an inner primary end surface positionable spatially disposed from the outer edge of the floor for sealing thereadjacent; and a lower primary and an upper primary surface extending between the opposing edges of the first element, a third element comprised of a thermally resistant material for insulating positioned in the safing slot, wherein the third element includes an inner primary end surface positionable in abutment with respect to the outer edge of the floor for sealing thereadjacent; an outer primary end surface positionable in abutment with respect to the inner primary end surface of the second element and spatially disposed from the inner surface of the first element; and a lower primary and an upper primary surface extending between the opposing edges of the first element.

In another aspect, the present invention provides a dynamic, thermally insulating and sealing system including a first element comprised of a non-combustible material for receiving a thermally resistant material for insulating, wherein the first element is comprised of a plate having opposing edges and an inner and an outer surface, wherein the plate is recessed at least 2 inch from an inner side of the framing member and extending at least 5 inch below the vertical framing member; and at least one supplemental element for attaching of the first element with respect to at least one side of the horizontal and/or vertical framing member of the curtain wall construction to ensure form closure. The remaining elements are the same as above.

In another aspect, the present invention provides a building construction comprising said thermally insulating and sealing system.

In yet another aspect, the present invention provides a dynamic, thermally insulating and sealing system, wherein parts of it are used as a pre-fabricated device for use within a unitized panel construction.

In yet another aspect, the present invention provides a dynamic, thermally insulating and sealing system which is suitable for acoustically insulating and sealing of a safing slot of a curtain wall structure.

BRIEF DESCRIPTION OF THE FIGURES

The subject matter of the present invention is further described in more detail by reference to the following figures.

DETAILED DESCRIPTION OF THE INVENTION

Figure 1:
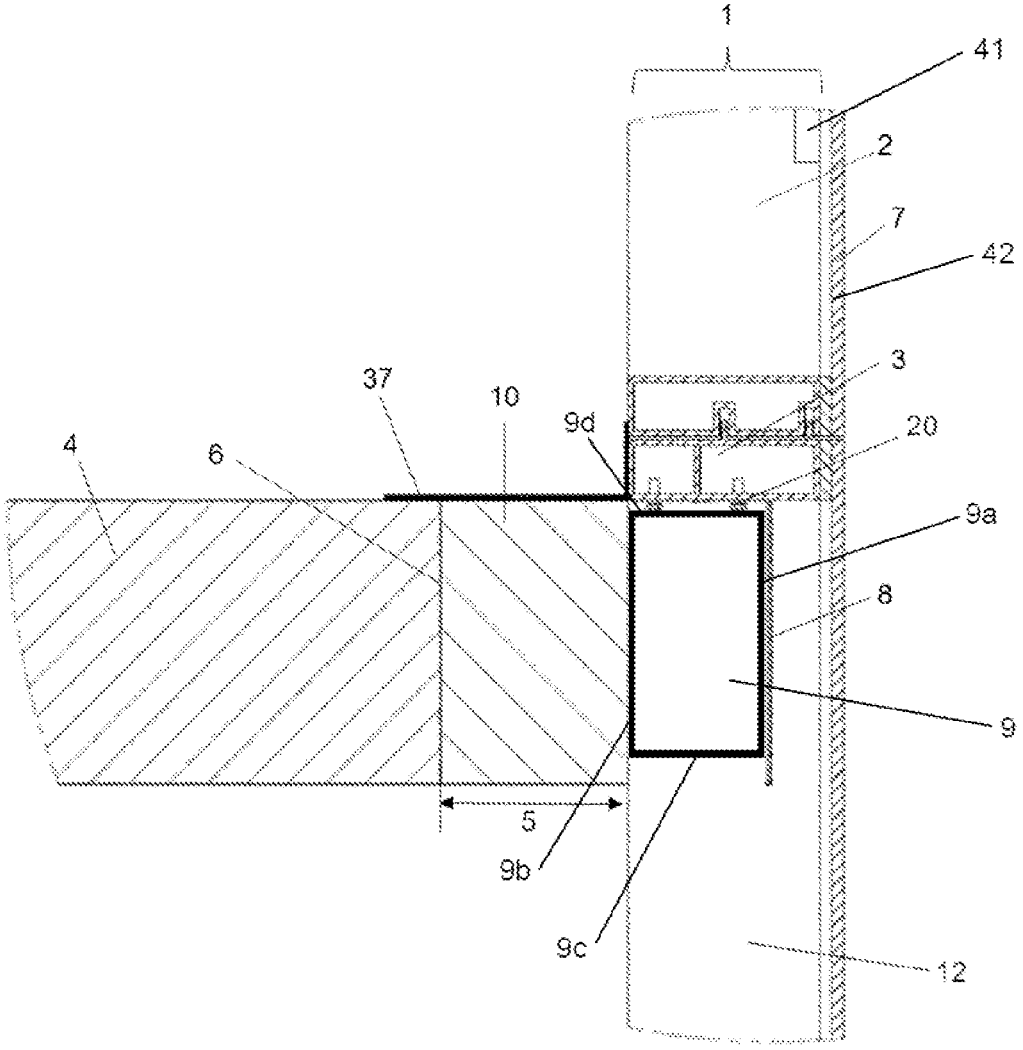
FIG. 1 shows a side cross-sectional view of an embodiment of the dynamic, thermally insulating and sealing system between the outer edge of a floor and the interior wall surface when initially installed and attached to a horizontal framing member (transom at floor level, i.e. zero spandrel) in a curtain wall construction, wherein the vision glass extends to the finished floor level below.

The following terms and definitions will be used in the context of the present invention:

As used in the context of present invention, the singular forms of "a" and "an" also include the respective plurals unless the context clearly dictates otherwise. Thus, the term "a" or "an" is intended to mean "one or more" or "at least one", unless indicated otherwise.

The term "curtain wall structure" or "curtain wall construction" in context with the present invention refers to a wall structure defined by an interior wall surface including one or more framing members and at least one floor spatially disposed from the interior wall surface of the curtain wall construction. In particular, this refers to a glass curtain wall construction or glass curtain wall structure defined by an interior wall glass surface including one or more extruded framing members, preferably made of aluminum, and at least one floor spatially disposed from the interior wall glass surface.

The term "safing slot" in context with the present invention refers to the gap between a floor and the interior wall surface of the curtain wall construction as defined above; it is also referred to as "perimeter slab edge", extending between the interior wall surface of the curtain wall construction, i.e., vision glass and framing member, and the outer edge of the floor.

The term "zero spandrel" in context with the present invention refers to a horizontal framing member, also called transom, which is located at floor level, i.e., bottom of the transom at the level as top of the floor, preferably concrete floor.

The term "interior wall surface" in context with the present invention refers to the inner facing surface of the curtain wall construction as defined above, in particular, to the inner facing surface of the infilled vision glass and the inner facing surface of the framing members.

The term "cavity-shaped profile" or "cavity-like profile" in context with the present invention refers to any shaped profile that is capable of receiving a thermally resistant material for insulating. In particular, the cavity-shaped profile refers to a L-shaped profile, U-shaped profile, a trapezoidal-shaped profile, a triangular-shaped profile, rectangular-shaped profile, octagonal-shaped profile, preferably to a U- or L-shaped cavity, such as a plate with a lip. These profiles can be formed from one or more components or can be integrally connected to the framing members thereby forming said profile.

The term "plate" in context with the present invention refers to any flat construction component, such as a sheet or panel being capable to be positioned within the framing structure of a curtain wall construction.

A glass curtain wall construction or glass curtain wall structure is defined by an interior wall glass surface including one or more framing members and at least one floor spatially disposed from the interior wall surface. Such curtain wall systems commonly include vertical framing members comprising boxed aluminum channels referred to as mullions and similarly configured horizontally extending pieces referred to as transoms. Such a transom located or transom configuration at floor level is also known as zero spandrel, i.e., bottom of the transom at the level as top of the concrete floor. Such glass curtain wall constructions lie within the code exception that the safing slot shall be permitted to be sealed with an approved material to prevent interior spread of fire.

The dynamic, thermally insulating and sealing system according to the present invention is comprised of different elements which provide in accordance with each other for a system that effectively thermally insulating and sealing of a safing slot within a building construction, in particular between a glass curtain wall structure and the edge of a floor, i.e. the zero spandrel area, wherein the vision glass of a curtain wall structure extends to the finished floor level below, and is described in the following:

According to the present invention the dynamic, thermally insulating and sealing system for effectively thermally insulating and sealing of a safing slot within a building construction having a curtain wall construction defined by an interior wall surface including at least one vertical and at least one horizontal framing member and at least one floor spatially disposed from the interior wall surface of the curtain wall construction defining the safing slot extending between the interior wall surface of the curtain wall construction and an outer edge of the floor, comprises:

i) a first element comprised of a non-combustible material for receiving a thermally resistant material for insulating, wherein the first element is comprised of a plate having opposing edges and an inner and an outer surface, and wherein the plate has a moment of inertia that is sufficient enough to keep a second and third element in place, wherein the plate is recessed at least 2 inch from an inner side of the framing member and extending at least 5 inch below the vertical framing member;

ii) at least one supplemental element for attaching of the first element with respect to at least one side of the horizontal and/or vertical framing member of the curtain wall construction, iii) a second element comprised of a thermally resistant material for insulating, wherein the second element includes:
   a) an outer primary end surface positionable in abutment with respect to the inner surface of the first element;
   b) an inner primary end surface positionable spatially disposed from the outer edge of the floor for sealing thereadjacent; and
   c) a lower primary and an upper primary surface extending between the opposing edges of the first element, iv) a third element comprised of a thermally resistant material for insulating positioned in the safing slot, wherein the third element includes:
   a) an inner primary end surface positionable in abutment with respect to the outer edge of the floor for sealing thereadjacent;
   b) an outer primary end surface positionable in abutment with respect to the inner primary end surface of the second element and spatially disposed from the inner surface of the first element; and
   c) a lower primary and an upper primary surface extending between the opposing edges of the first element.

In particular, the first element according to the present invention is for use in a fire-resistance rated and movement-rated curtain wall construction, wherein the curtain wall construction is comprised of a vision glass infill and at least one vertical and at least one horizontal metal framing member. The first element of the present invention is considered for the purpose of facilitating fire stopping by receiving and encasing a thermally resistant material positioned in a safing slot present in those buildings utilizing glass curtain wall structures, wherein the vision glass extends to the finished floor level, i.e., in the zero spandrel area of a glass curtain wall construction including only vision glass.

The first element is comprised of a non-combustible material for receiving a thermally resistant material for insulating, and is comprised of a plate having opposing edges and an inner and an outer surface, and wherein the plate has a moment of inertia that is sufficient enough to keep a second and third element in place, wherein the plate is recessed at least 2 inch from an inner side of the framing member and extending at least 5 inch below the vertical framing member. Further at least one supplemental element is comprised in the dynamic, thermally insulating and sealing system according to the present invention, which is for attaching of the first element with respect to at least one side of the horizontal and/or vertical framing member of the curtain wall construction.

It is preferred that the first element is comprised of non-combustible material, preferably a metal material, most preferably steel. In a most preferred embodiment, the first element is made of a 12 or 18 gauge galvanized steel material or aluminum, such as an extruded aluminum. However, it is also possible that the first element is comprised of a composite material or a material which is fiber-reinforced. The first element can also be integrally connected to the framing member(s), for example as within a unitized panel. In this embodiment the plate is preferably made from extruded aluminum.

In preferred embodiment, the first element comprises a plate that has a lip to form an L-shaped profile and can so be connected to a bottom side of the horizontal framing member. The connection of this L-shaped member can be via one or more screws, pins, bolts, anchors and the like. In a most preferred embodiment, a first leg of the first L-shaped member has a length of at least 1 inch and a second leg of the first L-shaped member has a length of at least 5 inch. However, it is also possible to form the L-shaped cavity-like profile using one or more pieces which are bent or somehow fastened for receiving a thermally resistant material for insulating.

In an alternative embodiment, the first element is comprised of a non-combustible material for receiving a thermally resistant material for insulating, and is comprised of a plate having opposing edges and an inner and an outer surface, and the plate is recessed at least 2 inch from an inner side of the framing member and extending at least 5 inch below the vertical framing member, and at least one supplemental element is comprised in the dynamic, thermally insulating and sealing system according to the present invention, which is for attaching of the first element with respect to at least one side of the horizontal and/or vertical framing member of the curtain wall construction ensure form closure. Preferably, the at least one supplemental element for attaching are at least two, more preferably four, most preferably five or more, attachment elements to ensure proper installation of the plate within the zero spandrel area.

The comprised at least one supplemental element of the first element for attaching of the first element with respect to at least one side of the horizontal and/or vertical framing member of the curtain wall construction is preferably selected from the group consisting of pins, expansion anchors, screws, screw anchors, bolts and adhesion anchors. Attachment of the first element with respect to the horizontal framing member of the curtain wall construction can alternatively also be performed by attaching it via an additional ledge section or bent section to the front side of the framing member(s). Preferably the at least one supplemental element is a No. 10 self-drilling sheet metal screw, most preferably a #10 hex-head self-drilling self-tapping sheet metal screw.

It is preferred that the at least one supplemental element of the first element for attaching extends through the lip of the first element and is attached to the bottom of the horizontal framing member of the curtain wall construction. However, any other suitable attachment region may be chosen as long as maintenance of complete sealing of the safing slot is guaranteed.

According to the invention is the outer surface of the first element positioned spatially disposed from the interior wall surface of the curtain wall construction, preferably spatially disposed from the inner surface of the vision glass infill.

Dimensions, material and geometric design of the first element may be varied and adapted to address joint width and transom location in a degree known to a person skilled in the art.

The second element of the dynamic, thermally insulating and sealing system according to the present invention is comprised of a thermally resistant material for insulating. The second element includes a second element comprised of a thermally resistant material for insulating, wherein the second element includes an outer primary end surface positionable in abutment with respect to the inner surface of the first element; an inner primary end surface positionable spatially disposed from the outer edge of the floor for sealing thereadjacent; and a lower primary and an upper primary surface extending between the opposing edges of the first element.

It is preferred that the second element comprises a thermally resistant material for insulating, preferably positioned in abutment with respect to the first element and spatially disposed from the edge of the floor, preferably a thermally resistant flexible material such as a mineral wool material, to facilitate placement thereof into the safing slot adjacent one another.

In a most preferred embodiment, the thermally resistant flexible mineral wool of the second element is a mineral wool bat insulation having a 3 inch thickness, 8-pcf density, installed with no compression.

The third element of the dynamic, thermally insulating and sealing system according to the present invention is comprised of a thermally resistant material for insulating positioned in the safing slot. The third element includes an inner primary end surface positionable in abutment with respect to the outer edge of the floor for sealing thereadjacent; an outer primary end surface positionable in abutment with respect to the inner primary end surface of the second element and spatially disposed from the inner surface of the first element; and a lower primary and an upper primary surface extending between the opposing edges of the first element.

It is preferred that the third element comprises a thermally resistant material for insulating positioned in the safing slot, preferably a thermally resistant flexible material such as a mineral wool material, to facilitate placement thereof into the safing slot adjacent to the second element.

In a most preferred embodiment, the thermally resistant flexible mineral wool of the third element is a flexible mineral wool material installed with fibers running parallel to the outer edge of the floor. Moreover, it is preferred that a min. 4 inch thick, 4-pcf density, mineral wool bat insulation is employed in the system of the present invention and most preferably installed with 25% compression.

According to the present invention, the second element and the third element each comprise a thermally resistant flexible mineral wool material to facilitate placement thereof into the safing slot and the cavity-like profile of the first element adjacent one another. The second and third element facilitate maintaining of abutment within the first element and the safing slot, and hence are independent responsive to thermal deforming of the interior wall surface.

The second and third element are simply hold by friction fit and compression in the safing slot and adjacent cavity-like profile of the first element. In case the plate is positioned in a unitized panel, the second element needs to be fastened to the first element by impaling pins, nails, bolts, screws or the like.

In the embodiment wherein the first element is comprised of a plate having opposing edges and an inner and an outer surface, and wherein the plate has a moment of inertia, the plate provides the rigidity so that the compression of the thermally resistant material for insulating is maintained.

However, in the embodiment, wherein the plate has no moment of inertia that is sufficient enough to keep the second and third element in place, the dynamic, thermally insulating and sealing system may further comprise a fourth element for supporting and attaching the first element with respect to an inner facing side of the vertical framing member of the curtain wall construction, wherein the fourth element has a substantially L-shaped profile and includes elements for attachment. The first element, the fourth element and/or parts of the framing members as such, may so form a cavity-like profile. This cavity-like profile serves the purpose of receiving a thermally resistant material for insulating. These supporting and attachment elements may also be used optionally when employing a plate that has a moment of inertia that is sufficient enough to keep the second and third element in place.

It is preferred that the fourth element of the dynamic, thermally insulating and sealing system is comprised of a non-combustible material, preferably a metal material, most preferably steel. In a particular preferred embodiment of the present invention, the fourth element is an angle bracket made from a 12 or 18 gauge galvanized steel material or aluminum, such as an extruded aluminum. In a most preferred embodiment, a first leg of the angle bracket has a length of at least 1 inch and a second leg of the angle bracket has a length of at least 1 inch. Dimensions and geometric design of the fourth element may be varied and adapted to address joint width and mullion location in a degree known to a person skilled in the art.

In a preferred embodiment of the present invention, the fourth element has attachment regions for facilitating attachment with respect to the vertical framing member and the first element within the spandrel area of the curtain wall construction. Preferably, the fourth element of the dynamic, thermally insulating and sealing system, comprises elements for attachment, as defined above, extending through the fourth element and are attached to the inner side of the vertical framing member. However, any other suitable attachment region may be chosen as long as maintenance of complete sealing of the safing slot is guaranteed.

According to the present invention, the dynamic, thermally insulating and sealing system may further comprise an additional element comprised of a thermally resistant material for insulating positioned in the safing slot in abutment with respect to the vertical framing member, i.e. located in front of the vertical framing member.

It is preferred that the thermally resistant material for insulating of the additional element, is a thermally resistant flexible material such as a mineral wool material, to facilitate placement thereof into the safing slot and in front of the vertical framing member.

In a particular preferred embodiment of the present invention, the additional element is integrally connected to the third element and made of a thermally resistant flexible mineral wool material installed with fibers running parallel to the outer edge of the floor. Moreover, it is preferred that a 12 inch long, 4-pcf density, mineral wool bat insulation is centered at the vertical framing member, i.e., mullion, and installed with 25% compression and depth to overcome the slab thickness. This installation is also referred to as the integrated mullion cover.

In a particular preferred embodiment of the present invention, the thermally resistant flexible mineral wool material of the third element is installed continuously and in abutment with respect to the outer edge of the floor, the second element, and the interior facing surface of the vertical framing member.

It is preferred that the upper as well as the lower primary surfaces of the second and third element of the dynamic, thermally insulating and sealing system according to the present invention are flush with respect to the upper and lower side of the floor, and the opposing edges of the plate, respectively.

According to the present invention, the dynamic, thermally insulating and sealing system may further comprise an outer fire retardant coating positioned across the third element and the adjacent portions of the at least one vertical and at least one horizontal framing member of the curtain wall construction and the floor located thereadjacent. The sealing characteristics of the construction shown in the present invention are significantly enhanced by the application of such fire retardant coating.

Generally, such fire retardant coatings are applied by spraying or other similar means of application. Such fire retardant coatings, in particular outer fire retardant coatings, are for example firestop joint sprays, preferably based on water, and self-leveling silicone sealants. For example, Hilti Firestop Joint Spray CFS-SP WB can be used as an outer fire retardant coating in accordance with the present invention. In one preferred embodiment of the present invention the outer fire retardant coating is a water-based or silicone-based outer fire retardant coating, preferably a firestop joint spray. The outer fire retardant coating that can be applied in the system of the present invention is preferably in the form of an emulsion, spray, coating, foam, paint or mastic.

According to one embodiment of the present invention, it is preferred that the outer fire retardant coating has a wet film thickness of at least ⅛ inch. Additionally, it is preferable that the outer fire retardant coating covers the top of the thermally resistant flexible mineral wool material overlapping the outer edge of the floor and the interior face of the at least one vertical and at least one horizontal framing member surface of the curtain wall construction by a min. of ½ inch. The outer fire retardant material can be applied across the third element and the adjacent areas of the interior wall surface and floor.

According to the present invention, the dynamic, thermally insulating and sealing system may further comprise a silicone sealant, preferably a firestop silicone, in order to restrict air movement and to serve as a vapor barrier. The application of a silicone sealant allows the usage of an unfaced curtain wall insulating material, i.e., mineral wool without any foil or tape around the outside, in particular in cases, where the cavity-like profile consists of more the one pieces.

According to the present invention, the dynamic, thermally insulating and sealing system is initially installed within the zero spandrel area of a glass curtain wall construction.

In a first step, the first element is fastened to a framing member. In a preferred embodiment, a lip of the first L-shaped member is installed and fastened to the bottom of the horizontal framing member using the elements for attachment, preferably self-drilling screws. Once the first member is installed, optionally a fourth member with respect to the vertical framing member is installed in case the plate has no moment of inertia that is sufficient enough to keep a second and third element in place. The first element is installed such that the outer surface of the first element is positioned spatially disposed from the interior wall surface of the curtain wall construction, preferably spatially disposed from the inner surface of the vision glass infill.

In a second step, the second element, preferably 8-pcf density, unfaced mineral wool—also referred to as unfaced curtain wall insulation—is friction-fitted or fastened to an inner facing surface of the first element by impaling pins, nails, bolts, screws or the like. The outer primary end surface is positioned in abutment with respect to the inner surface of the first element, the inner primary end surface is positioned spatially disposed from the outer edge of the floor, and the lower primary and the upper primary surface extend between the opposing edges of the first element.

In a third step, the third element, preferably mineral wool with 4 inch depth is continuously installed with 25% compression into the safing slot with its inner primary end surface positioned in abutment with respect to the outer edge of the floor and its outer primary end surface positioned in abutment with respect to the inner primary end surface of the second element and spatially disposed from the inner surface of the first element. The lower primary and the upper primary surface extended extending between the opposing edges of the first element.

In a fourth step, a fire retardant coating is applied across the third element and the adjacent portions of the at least one vertical and at least one horizontal framing member of the curtain wall construction and the floor located thereadjacent. Said fire retardant coating, in particular, the outer fire retardant coating, may be for example a silicone-base fire retardant coating, such as Hilti CFS-SP WB or SIL firestop joint spray having a wet thickness of at least ⅛ inch. The outer fire retardant coating covers the top of the thermally resistant flexible mineral wool material overlapping the outer edge of the floor and the interior face of the at least one vertical and at least one horizontal framing member surface of the curtain wall construction by a min. of ½ inch.

When installing, the insulating elements are compressed to varying degrees, but normally compressed to approximately 25% in comparison to a standard of 33%. This compression will cause exertion of a force outwardly against the other elements of the system in order to expand outwardly to fill voids created in the safing slot.

The dynamic, thermally insulating and sealing system according to the present invention is preferably for use with a building construction defined by an interior wall surface including one or more framing members and at least one floor spatially disposed from the interior wall surface of the curtain wall construction defining the safing slot extending between the interior wall surface of the curtain wall construction and an outer edge of the floor.

In particular, the building construction comprises a dynamic, thermally insulating and sealing system for effectively thermally insulating and sealing of the safing slot as defined above.

It is preferred that the building construction comprises a curtain wall construction that is comprised of a vision glass infill and at least one vertical and at least one horizontal metal framing member.

The dynamic, thermally insulating and sealing system according to the present invention moreover serves as a construction part when building up unitized panels. In particular, the first and the second element are used as a pre-fabricated device for use within a unitized panel construction. The first element is preferably installed during the build-up of the unitized panel. Generally, unitized panels are built from one side of the finished product, usually glass side.

A unitized curtain wall panel production allows the curtain wall manufacturers to install all required curtain wall components off site and then ship the complete unitized panel onsite for an easy quick installation on to the building.

The following steps are completed while the panel is manufactured on a flat horizontal surface. First, the frame of the unitized panel (i.e. mullions, upper transom, lower transom) is built up. In a second step, the first element and optionally the fourth element are installed to the unitized panel with the appropriate fasteners in a similar manner as described above. The glass is installed to the unitized panel and then the panel is flipped over to gain proper access to the first element in order to optionally install the thermally resistant material for insulating (second element). This complete unitized panel with zero spandrel insulation is then delivered and hung at the jobsite. Once the panels are hung and adjusted, the thermally resistant material for insulating (third element) is installed in the curtain wall joint, i.e. safing slot. After the thermally resistant material is properly installed, the outer fire retardant coating is applied to the top surface.

The dynamic, thermally insulating and sealing system of the present invention is also for acoustically insulating and sealing of a safing slot of a curtain wall structure. The material used for insulating may be of a sound resistant and/or air tight material, such as a mineral wool material coated with an acrylic- or silicone-based material, rubber-like material or a foam, such for example an elastomeric interlaced foam based on synthetic rubber (Armaflex), a polyethylene foam, a polyurethane foam, a polypropylene foam or a polyvinyl chloride foam.

While the invention is particularly pointed out and distinctly described herein, a preferred embodiment is set forth in the following detailed description which may be best understood when read in connection with the accompanying drawings.

In FIG. 1 is shown a side cross-sectional view of an embodiment of the dynamic, thermally insulating and sealing system between the outer edge of a floor and the interior wall surface when initially installed and attached to a horizontal framing member (transom at floor level, i.e. zero spandrel) in a curtain wall construction, wherein the vision glass extends to the finished floor level below—glass curtain wall construction. In particular, the dynamic, thermally insulating and sealing system is initially installed within the zero spandrel area of a glass curtain wall construction, defined by an interior wall surface 1 including one or more framing members, i.e., vertical framing member—mullion 2—and horizontal framing member—transom 3—which is located at the floor level, and at least one floor 4 spatially disposed from the interior wall surface 1 of the curtain wall construction defining the safing slot 5 extending between the interior wall surface 1 of the curtain wall construction and an outer edge 6 of the floor 4. The framing members 2 and 3 are infilled with vision glass 7 extending to the finished floor level below. The dynamic, thermally insulating and sealing system of the present invention comprises a first element 8 comprised of a non-combustible material for receiving a thermally resistant material for insulating a second element 9 (not shown in FIG. 1) comprised of a thermally resistant material for insulating positioned in the first element 8, and a third element 10 comprised of a thermally resistant material for insulating positioned in the safing slot. Further, the dynamic, thermally insulating and sealing system of the present invention comprises a fourth element 11 (not shown in FIG. 1) for supporting and attaching the first element with respect to an inner facing side 12 of the vertical framing member 2 of the curtain wall construction, in particular, if a plate is used having no moment of inertia sufficient enough to keep the second and third element in place. In FIG. 1, the first element 8 is comprised of a non-combustible material, such as metal, preferably made from an 18 gauge galvanized steel material, and is a plate having opposing edges and an inner and an outer surface, and wherein the plate has a moment of inertia that is sufficient enough to keep the second and third element in place, wherein the plate is recessed at least 2 inch from an inner side of the framing member 2, 3 and extending at least 5 inch below the vertical framing member 2. The at least one supplemental element 20 for attaching of the first element 8 with respect to a bottom side of the horizontal framing member 3 of the curtain wall construction. The supplemental element 20 is preferably a No. 10 self-drilling sheet metal screw, such as a #10 hex-head self-drilling self-tapping sheet metal screw. The supplemental element 20 of the first element 8 for attaching extends through a lip of the first element 8 and is attached to the bottom of the horizontal framing member 3 of the curtain wall construction. The outer surface of the first element 8 is positioned spatially disposed from the interior wall surface of the curtain wall construction, especially spatially disposed from the inner surface of the vision glass infill 7. The second element 9 (not shown) is comprised of a thermally resistant material for insulating positioned in the first element 8. The second element 9 includes an outer primary end surface positionable in abutment with respect to the inner surface of the first element 8; an inner primary end surface positionable spatially disposed from the outer edge 6 of the floor 4 for sealing thereadjacent; and a lower primary and an upper primary surface extending between the opposing edges of the first element 8. The thermally resistant material for insulating of the second element 9, is mineral wool, preferably a min. 8-pcf density unfaced curtain wall insulation having a thickness of 3 inch, and installed within the cavity of first element 8. The third element 10 of the dynamic, thermally insulating and sealing system is comprised of a thermally resistant material for insulating positioned in the safing slot. The third element includes an inner primary end surface positionable in abutment with respect to the outer edge 6 of the floor 4 for sealing thereadjacent; an outer primary end surface positionable in abutment with respect to the inner primary end surface of the second element 9 and spatially disposed from the inner surface of the first element 8; and a lower primary and an upper primary surface extending between the opposing edges of the first element 8. The thermally resistant material for insulating of the third element 10, is mineral wool, preferably having a min. 4-pcf density and a thickness of 4 inch. Not shown in FIG. 1 is that the thermally resistant flexible mineral wool material of the third element 10 is installed with fibers running parallel to the outer edge 6 of the floor 4. In FIG. 1, an outer fire retardant coating 37 is positioned across the third element 10 and the adjacent portions of the at least one vertical 2 and at least one horizontal framing member 3 of the curtain wall construction and the floor 4 located thereadjacent in order to further maintain a complete seal extending within the safing slot 5 in those conditions where the interior wall surface 1 has expanded beyond the lateral expansion capability of the insulating elements.

Figure 2:
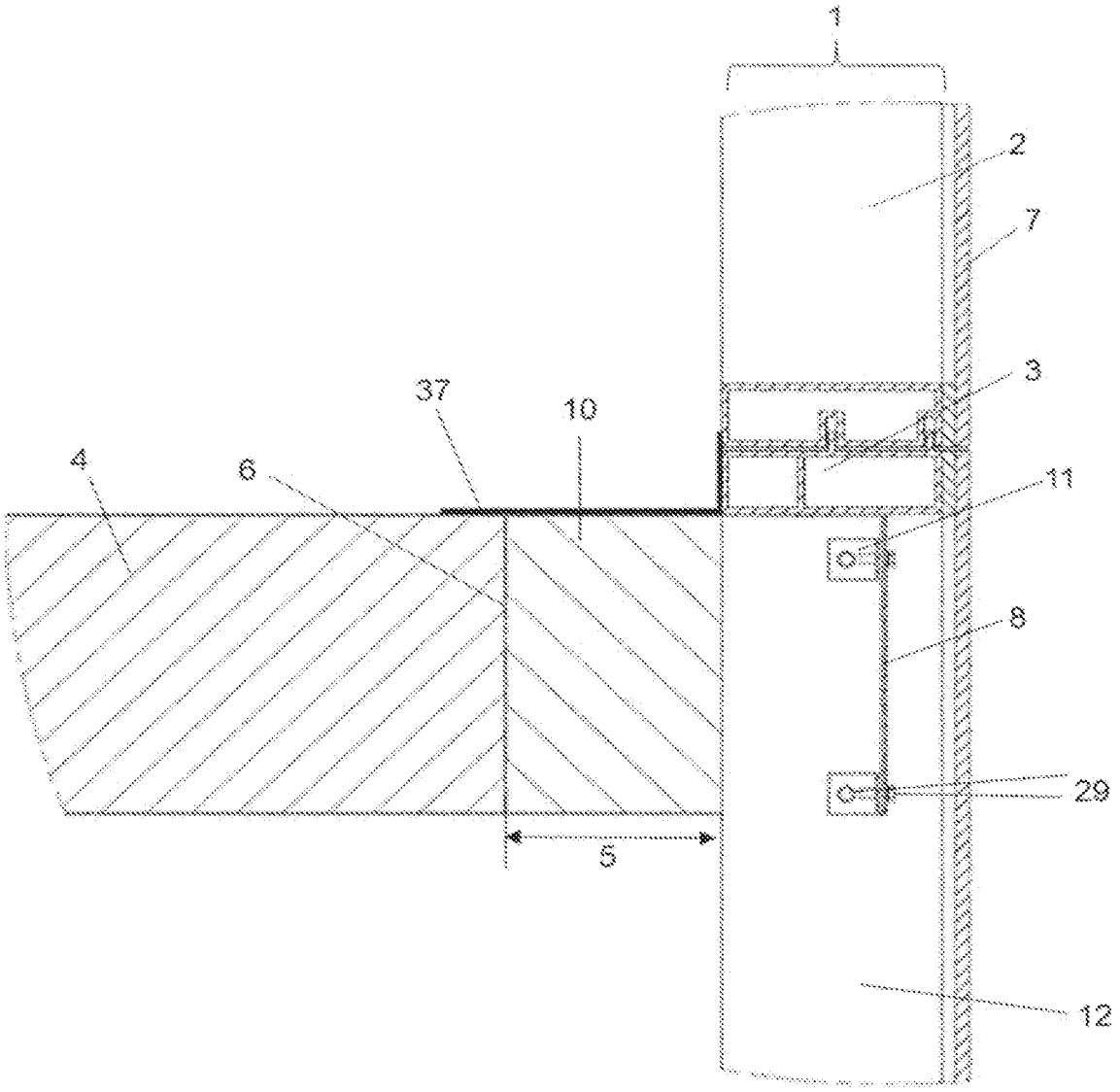
FIG. 2 shows a side cross-sectional view of another embodiment of the dynamic, thermally insulating and sealing system between the outer edge of a floor and the interior wall surface when initially installed and attached additionally to a vertical framing member (mullion) in a curtain wall construction, wherein the vision glass extends to the finished floor level below.

FIG. 2 shows a side cross-sectional view of another embodiment of the dynamic, thermally insulating and sealing system, between the outer edge of a floor and the interior wall surface when initially installed and attached additionally to a vertical framing member (mullion) in a curtain wall construction, wherein the vision glass extends to the finished floor level below. FIG. 2 shows the same components of the system as described for FIG. 1, but the plate (first element 8) has no moment of inertia sufficient enough to keep the second and third element in place. In this case, the dynamic, thermally insulating and sealing system comprises a fourth element 11 for supporting and attaching the first element 8 with respect to an inner facing side 12 of the vertical framing member 2 of the curtain wall construction, wherein the fourth element 11 has a substantially L-shaped profile and includes elements for attachment 29. The fourth element 11 is comprised of a non-combustible material, preferably a metal material, most preferably steel. As shown in FIG. 2, the fourth element 11 is an angle bracket. The elements for attachment 29 are No. 10 self-drilling sheet metal screws, preferably #10 hex-head self-drilling self-tapping sheet metal screws. The remaining components are the same as for FIG. 1.

It should be appreciated that these embodiments of the present invention will work with many different types of insulating materials used for the second element and third element as well as different types of the non-combustible material used for the first and fourth element as long as the material has effective high temperature insulating characteristics. Each unitized panel manufacturer/curtain wall manufacturer/constructor has its own architectural design, which requires minor adjustments to the construction process. These include but are not limited to the water-tight gaskets, anchor bracket attachment method, and mullion/transom design.

It has been shown that the simplified dynamic, thermally insulating and sealing system of the present invention decrease the complexity in the manufacturing of unitized panels and reduces significantly the cost of materials employed.

It has been further shown, that the dynamic, thermally insulating and sealing system of the present invention for sealing between the edge of a floor and an interior wall surface of a glass curtain wall construction maintains sealing of the safing slots surrounding the floor of each level in a building.

It has been demonstrated that the dynamic, thermally insulating and sealing system for a glass curtain wall structure of the present invention is capable of meeting or exceeding existing fire test and building code requirements including existing exceptions. In particular, the system prevents the spread of fire when vision glass of a curtain wall structure extends to the finished floor level below, thereby addressing the architectural limitation of the width of a column or spandrel beam or shear wall behind the curtain wall. Additionally, maintaining safing insulation between the floors of a residential or commercial building and the exterior curtain wall responsive to various conditions including fire exposure is guaranteed.

The system according to the present invention can be pre-installed from one side, which maintains the safing insulation between the floors of a residential or commercial building and the glass curtain wall responsive to various conditions, including fire exposure and exposure to movement, and maximizes safing insulation at a minimal cost. The system can be easily installed within a safing slot, where, for example, access is only needed from one side, implementing a one-sided application.

In particular, the system according to the present invention provides for the employment of reduced curtain wall insulation to only 5-6 inch height, resulting in up to 40% curtain wall material savings to the closest 10 inch spandrel system. Further, no top horizontal transom cover is needed for maximum vision glass/architectural exposure top of slab. Another great advantage of the dynamic, thermally insulating and sealing system of the present invention is that mineral wool is not exposed and does not need to be superior water resistant from all directions, no fiber distribution can occur to the air and no mineral wool is visible for architectural looks. Further, no stiffeners, hat channel, weld pins or similar means are needed to install/fasten the insulation, rather it can be simply fitted by friction fit. Additionally, the mineral wool is installed with only 25% compression, whereas standard systems require 33% compression.

It has been also shown that a building construction is provided comprising such a dynamic, thermally insulating and sealing system for effectively thermally insulating and sealing of the safing slot between a glass curtain wall structure and the edge of a floor, in particular within the zero spandrel area, wherein the vision glass of a curtain wall structure extends to the finished floor level below, thereby creating a continuous fireproofing seal extending from the outermost edge of the floor to the curtain wall structure and, in particular, to abutment with the interior wall surface.

Further, the dynamic, thermally insulating and sealing system is not limited to a specific joint width or spandrel height; installation on the face of the transom is possible.

It has been shown that the system can be installed into a unitized panel, making it easier for the installers to build up the curtain wall on the jobsite. A unitized curtain wall panel production allows the curtain wall manufacturers to install all required curtain wall components off site and then ship the complete unitized panel onsite for an easy quick installation on to the building.

As such, the dynamic, thermally insulating and sealing system of the present invention provides a system for effectively maintaining a complete seal in a safing slot when utilizing a glass curtain wall construction, vision glass extends to the finished floor level below.

The curtain wall design of the present invention clearly simplifies fire protection installation and can be used to add additional insulation for other mechanical purposes, such as for example STC, R-value, and the like.

Finally, it has been shown that the dynamic, thermally insulating and sealing system according to the present invention is also for acoustically insulating and sealing of a safing slot of a curtain wall structure.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

The invention claimed is:

1. A dynamic, thermally insulating and sealing system for effectively thermally insulating and sealing of a safing slot within a building construction, having a curtain wall construction defined by an interior wall surface including at least one vertical framing member and at least one horizontal framing member and at least one floor spatially disposed from the interior wall surface of the curtain wall construction, thereby defining the safing slot extending between the interior wall surface of the curtain wall construction and an outer edge of the floor, the dynamic, thermally insulating and sealing system comprising:

a first element comprised of a plate having opposing edges and an inner surface and an outer surface, wherein the plate is recessed from an inner side of the at least one vertical framing member and extends below the at least one vertical framing member in an installed state;

at least one supplemental element configured to attach the first element to at least one side of the at least one horizontal framing member and/or the at least one vertical framing member of the curtain wall construction in the installed state, a second element comprised of a thermally resistant material for insulating, wherein the second element includes:

an outer primary end surface adjacent to the inner surface of the first element;

an inner primary end surface positionable spatially disposed from the outer edge of the floor in the installed state for sealing thereadjacent; and a lower primary surface and an upper primary surface extending between the opposing edges of the first element, and a third element comprised of a thermally resistant material for insulating and positioned in the safing slot in the installed state, wherein the third element includes:

an inner primary end surface adjacent to the outer edge of the floor in the installed state for sealing thereadjacent;

an outer primary end surface adjacent to the inner primary end surface of the second element and spatially disposed from the inner surface of the first element; and a lower primary surface and an upper primary surface extending between the opposing edges of the first element, and a fourth element configured to support and attach the first element with respect to the inner side of the at least one vertical framing member of the curtain wall construction in the installed state, wherein the fourth element comprises a metal; and wherein the plate has a moment of inertia that is sufficient enough to keep the second element and the third element in place.

2. The dynamic, thermally insulating and sealing system according to claim 1, wherein the fourth element has a substantially L-shaped profile and includes elements for attachment.

3. The dynamic, thermally insulating and sealing system according to claim 1, wherein the first element and/or the fourth element at least partially form a cavity to receive the second element.

4. The dynamic, thermally insulating and sealing system according to claim 1, wherein the plate is recessed at least 2 inches from the inner side of the at least one vertical framing member and extends at least 5 inches below the at least one vertical framing member in the installed state.

5. The dynamic, thermally insulating and sealing system according to claim 1, wherein the first element is comprised of a metal material.

6. The dynamic, thermally insulating and sealing system according to claim 5, wherein the first element is comprised of steel.

7. The dynamic, thermally insulating and sealing system according to claim 1, wherein the second element and the third element each comprise a thermally resistant flexible mineral wool material disposed in a cavity at least partially formed by the first element and the safing slot, adjacent one another.

8. The dynamic, thermally insulating and sealing system according to claim 1, wherein the fourth element comprises at least one fastener selected from the group consisting of pins, expansion anchors, screws, screw anchors, bolts, and adhesion anchors.

9. The dynamic, thermally insulating and sealing system according to claim 1, wherein the at least one supplemental element extends through a lip of the first element and is attached to a bottom side of the at least one horizontal framing member of the curtain wall construction in the installed state.

10. The dynamic, thermally insulating and sealing system according to claim 1, further comprising:

an outer fire retardant coating, positioned across the third element and adjacent portions of the at least one vertical framing member and the at least one horizontal framing member of the curtain wall construction and the floor located thereadjacent in the installed state.

11. The dynamic, thermally insulating and sealing system according to claim 1, wherein the outer surface of the first element is positioned spatially disposed from the interior wall surface of the curtain wall construction in the installed state.

12. A building construction, having:

a curtain wall construction comprising an interior wall surface including one or more framing members and at least one floor spatially disposed from the interior wall surface of the curtain wall construction, defining a sating slot extending between the interior wall surface of the curtain wall construction and an outer edge of a floor, wherein the curtain wall construction comprises the dynamic, thermally insulating and sealing system as defined in claim 1 for thermally insulating and sealing of the sating slot.

13. The dynamic, thermally insulating and sealing system according to claim 1, wherein the first element and the second element are pre-fabricated as a pre-fabricated device for assembly within a unitized panel construction.

14. The dynamic, thermally insulating and sealing system according to claim 1, wherein the curtain wall construction comprises a vision glass infill, at least one vertical metal framing member, and at least one horizontal framing member; wherein the outer surface of the first element is positioned spatially disposed from an inner surface of the vision glass infill in the installed state.

15. A dynamic, thermally insulating and sealing system for effectively thermally insulating and sealing of a safing slot within a building construction, having a curtain wall construction defined by an interior wall surface, including at least one vertical framing member and at least one horizontal framing member and at least one floor spatially disposed from the interior wall surface of the curtain wall construction, thereby defining the sating slot extending between the interior wall surface of the curtain wall construction and an outer edge of the floor, the dynamic, thermally insulating and sealing system comprising:

a first element comprising a plate having opposing edges and an inner surface and an outer surface, wherein the plate is recessed from an inner side of the at least one of the vertical framing member and extends below the at least one vertical framing member in an installed state;

at least one supplemental element configured to attach the first element to at least one side of the at least one horizontal framing member and/or the at least one vertical framing member of the curtain wall construction in the installed state, a second element comprised of a thermally resistant material for insulating, wherein the second element includes:

an outer primary end surface adjacent to the inner surface of the first element;

an inner primary end surface adjacent spatially disposed from the outer edge of the floor in the installed state for sealing thereadjacent; and a lower primary surface and an upper primary surface extending between the opposing edges of the first element, and a third element comprised of a thermally resistant material for insulating, positioned in the safing slot in the installed state, wherein the third element includes:

an inner primary end surface adjacent to the outer edge of the floor in the installed state for sealing thereadjacent;

an outer primary end surface adjacent to the inner primary end surface of the second element and spatially disposed from the inner surface of the first element; and a lower primary surface and an upper primary surface extending between the opposing edges of the first element, and a fourth element configured to support and attach the first element with respect to the inner side of the at least one vertical framing member of the curtain wall construction in the installed state, wherein the fourth element comprises a metal.

* * * * *